US007396123B2

(12) United States Patent
Sootome et al.

(10) Patent No.: US 7,396,123 B2
(45) Date of Patent: Jul. 8, 2008

(54) TRANSPORT APPARATUS AND RECORDING APPARATUS

(75) Inventors: Sumitoshi Sootome, Mishima (JP); Tadashi Matsumoto, Adachi-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 468 days.

(21) Appl. No.: 11/143,174

(22) Filed: Jun. 2, 2005

(65) Prior Publication Data

US 2005/0270355 A1 Dec. 8, 2005

(30) Foreign Application Priority Data

Jun. 3, 2004 (JP) ..... 2004-165803
Jun. 3, 2004 (JP) ..... 2004-165804

(51) Int. Cl.

| | |
|---|---|
| ***B41J 2/01*** | (2006.01) |
| ***B41J 13/08*** | (2006.01) |
| ***B41J 3/60*** | (2006.01) |
| ***B65H 15/00*** | (2006.01) |
| ***B65H 85/00*** | (2006.01) |
| ***B65H 29/16*** | (2006.01) |
| ***B65H 5/22*** | (2006.01) |

(52) U.S. Cl. ..... 347/104; 400/635; 400/629; 400/76; 271/275; 271/193

(58) Field of Classification Search ..... None
See application file for complete search history.

(56) References Cited

U.S. PATENT DOCUMENTS 4,918,490 A * 4/1990 Stemmle ..... 399/401
6,267,225 B1 * 7/2001 Compera et al. ..... 198/691
6,578,944 B1 * 6/2003 Kamei et al. ..... 347/16
6,595,515 B2 * 7/2003 Numata et al. ..... 271/193
2003/0052955 A1 * 3/2003 Kanome ..... 347/104
2004/0179053 A1 * 9/2004 Itoh ..... 347/16
2004/0253013 A1 * 12/2004 Furukawa ..... 399/49

FOREIGN PATENT DOCUMENTS

JP 05162881 A * 6/1993
JP 09269621 A * 10/1997
JP 2002-284383 A 10/2002

* cited by examiner

*Primary Examiner*—Daniel J Colilla
(74) *Attorney, Agent, or Firm*—Canon USA Inc I.P. Div

(57) ABSTRACT

A recording apparatus includes a recording unit for recoding on a recording medium by ejecting ink, a conveyor belt for transporting the medium, first and second electrode groups including a plurality of electrodes inside the conveyor belt, a charging unit for charging the first and second electrode groups to provide a potential difference between the first and second electrode groups in order to generate an electrostatic force for attracting the medium to the conveyor belt, a duplex transport unit for turning over the medium transported by the conveyor belt from a first surface upward to a second surface upward and delivering the medium to the conveyor belt with the second surface upward, and a control unit for controlling the charging unit so that a difference between the potentials of the first and second electrode groups during transportation of the medium with the second surface upward is different from that during transportation of the medium with the first surface upward.

5 Claims, 10 Drawing Sheets

FIG. 6A
$$F = \frac{\varepsilon S}{2d^2}(V - V_1 - V_2)^2$$
FIG. 6B
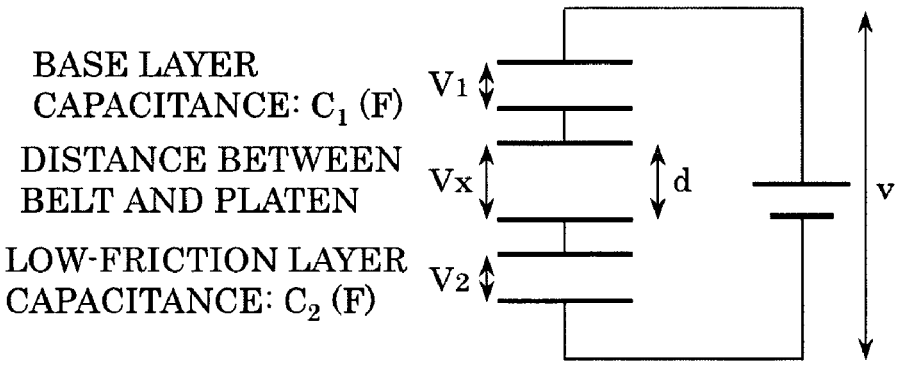
FIG. 6C
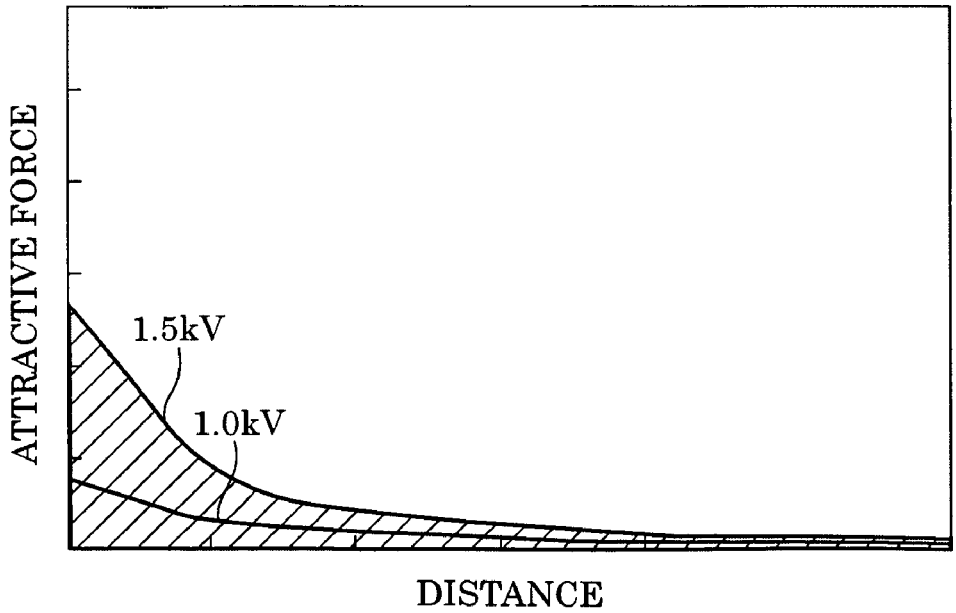

TRANSPORT APPARATUS AND RECORDING APPARATUS

BACKGROUND OF THE INVENTION

1. Field of the Invention

The present invention relates to a transport apparatus including a conveyer belt for attracting and conveying a recording medium and to a recording apparatus for recording on the recording medium conveyed by the transport apparatus.

2. Description of the Related Art

In general, inkjet recording apparatuses carry out recording by ejecting ink drops from a recording head onto a recording medium conveyed by a transport mechanism. The inkjet recording apparatuses have advantages in that the size of the recording head can be easily reduced, high-resolution images can be recorded at high speed, the running cost can be reduced, noise can be reduced because of a non-impact mechanism, and a color image can be easily recorded by using ink of a plurality of colors. In particular, full-line type inkjet recording apparatuses include a line-type recording head having a plurality of ejection nozzles arranged in the width direction of the recording medium. Therefore, the full-line type inkjet recording apparatuses can provide higher speed recording.

However, among the full-line type inkjet recording apparatuses, apparatuses including a plurality of line-type recording heads in the moving direction of the recording medium have a large distance between the furthest upstream recording head and the furthest downstream recording head. Therefore, if moisture content of the recording area of the recording medium increases, the recording medium could slightly lift. This prevents an ink drop ejected from a recording head from being put on a desired position, and therefore, the recording quality is degraded. Accordingly, to prevent this phenomenon, it is necessary to press the recording medium against the transport mechanism.

In order to press the recording medium against the transport mechanism, a method is widely known in which the transport mechanism includes an electrode, which is charged to generate an electrostatic force so as to attract the recording medium (refer to, for example, Japanese Patent Laid-Open No. 2002-284383).

On the other hand, recently, recording on both sides of a recording medium has been required in many cases in addition to recoding on only one side of a recording medium. When recording on both sides of a recording medium, a recording head first ejects ink onto the first surface and then ejects ink onto the second surface. In this case, since recording on the first surface increases moisture content of the recording medium, the recording medium could significantly swell and ripple (cockle). Thus, the recording quality on the second surface is degraded compared to single-sided recording. If the above-described conveying method is applied to the double-sided recording, the recording quality required at that time can be satisfied. However, recently, higher recording quality has been required.

In addition, if a conveying belt is used to convey the recording medium and if the conveying belt remains unused in the apparatus for a long period of time, permanent deformation may occur at a portion having a large curvature, such as a portion in contact with a transport roller.

SUMMARY OF THE INVENTION

The present invention is directed to a transport apparatus and a recording apparatus for reliably attracting a recording medium to a transport unit during double-sided recording even when moisture content of the recording medium increases.

According to an aspect of the present invention, a transport apparatus includes a transport unit for transporting a recording medium and including an attractive force generation unit having an electrode for attracting the recording medium by applying a voltage to the electrode, a duplex transport unit for turning over the recording medium transported by the transport unit from a first surface upward to a second surface upward and re-transporting the recording medium to the transport unit in order to transport the recording medium with the second surface upward, and a storage unit for storing a recording amount on the recording medium, and a control unit for controlling the attractive force generation unit to change the voltage applied to the electrode based on the recording amount stored in the storage unit so that a difference between potentials of the transport unit and the recording medium during transportation of the recording medium with the second surface upward is greater than a difference between potentials of the transport unit and the recording medium during transportation of the recording medium with the first surface upward.

Since the transport apparatus changes the voltage applied to the transport unit based on the recording amount stored in the storage unit so that a difference between potentials of the transport unit and the recording medium during transportation of the recording medium with the second surface upward is greater than that during transportation of the recording medium with the first surface upward, the greater difference between potentials of the transport unit and the recording medium during transportation of the recording medium with the second surface upward increases the attractive force of the transport unit for the recording medium even when moisture content of the recording medium increases. As a result, the recording medium can be reliably attracted to the transport unit.

The present invention provides the above-described structure and operation. Accordingly, a recording medium can be reliably attracted to a conveyor belt during double-sided recording even when moisture content of the recording medium increases.

Further features and advantages of the present invention will become apparent from the following description of exemplary embodiments with reference to the attached drawings.

BRIEF DESCRIPTION OF THE DRAWINGS

FIGS. 6A, 6B, and 6C are diagrams illustrating an attractive force between the conveyor belt and a platen.

DESCRIPTION OF THE EMBODIMENTS

First Embodiment

An embodiment of a recording-medium transport apparatus will be described in detail below with reference to the accompanying drawings. In the following embodiments, the recording-medium transport apparatus used for an inkjet recording apparatus that carries out recording by ejecting ink drops is described as an example.

A recording apparatus including a recording-medium transport apparatus according to a first embodiment is described next with reference to the accompanying drawings.

Figure 1:
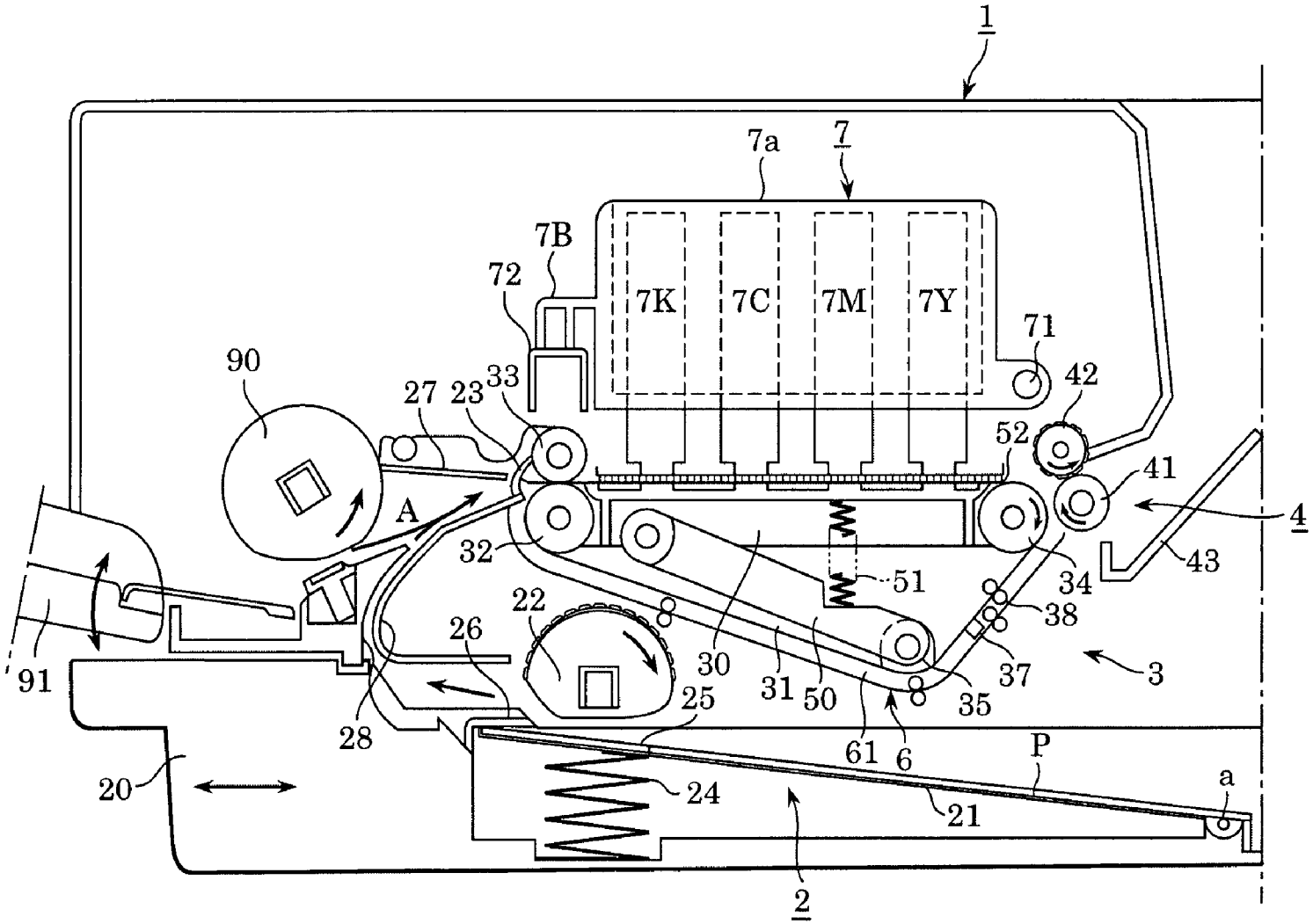
FIG. 1 is a block diagram of the overall structure of a recording apparatus according the present invention.

First, the overall structure of the recording apparatus is described next with reference to the accompanying drawings. The recording apparatus having an automatic feeder unit includes a feeder unit, a conveyor belt unit (transport apparatus), a duplex transport unit attached to the conveyor belt unit, an output unit, and a recording head unit. FIG. 1 is a sectional view illustrating the overall structure of a recording apparatus 1. As shown in FIG. 1, the recording apparatus 1 includes a feeder unit 2, a conveyor belt unit 3, a duplex transport unit 6, a recording unit 7, and an output unit 4.

The feeder unit 2 includes a platen 21 on which a recording medium P is mounted and a feeding rotator 22, both of which are fixed to a base 20. The feeding rotator 22 feeds the recording medium P. The platen 21 is rotatable about a rotation shaft "a" secured to the base 20 and is pressed against the feeding rotator 22 by a platen spring 24. On an area of the platen 21 facing the feeding rotator 22, a separation pad 25 is attached. The separation pad 25 is composed of a material having a high friction coefficient, such as artificial suede, in order to prevent double feeding. Also, a separation claw 26 and a release cam (not shown) are fixed to the base 20. The separation claw 26 covers corners on one side of the recording medium P to separate the recording medium P one by one. The release cam releases the contact between the platen 21 and the feeding rotator 22.

According to this configuration, in a ready mode, the release cam pushes down the platen 21 to a predetermined position. Thus, the contact between the platen 21 and the feeding rotator 22 is released. Subsequently, when the driving force of a transport roller 32 is transferred to the feeding rotator 22 and the release cam via a gear, the release cam moves away from the platen 21, and therefore, the platen 21 moves upward. The feeding rotator 22 is brought into contact with the recording medium P. With the rotation of the feeding rotator 22, the recording medium P is picked up and the feeding starts. The recording medium P is separated one by one by the separation claw 26 and is sequentially delivered to the conveyor belt unit 3. The feeding rotator 22 rotates until the recording medium P is transferred to the conveyor belt unit 3. When the recording medium P is transferred to the conveyor belt unit 3, the apparatus enters a ready mode, in which the contact between the platen 21 and the feeding rotator 22 is released, again. The driving force of the transport roller 32 is then shut off.

A feeding rotator 90 is used for manual feed. The feeding rotator 90 rotates in response to a recording command signal from a computer so that the recording medium P on a manual tray 91 is moved to the transport roller 32.

The conveyor belt unit 3 holds the recording medium P on a conveyor belt (conveyer member) 31 to convey the recording medium P. The conveyor belt unit 3 includes the conveyor belt 31 for conveying the recording medium P and a PE sensor (not shown).

The conveyor belt 31 includes an attractive force generation unit 36 for holding the recording medium P on the conveyor belt 31.

The conveyor belt 31 is driven by a driving roller 34. The conveyor belt 31 passes over transport roller 32 and a pressure roller 35, which are driven rollers. The transport roller 32 and the driving roller 34 are rotatably attached to a platen 30. The pressure roller 35 is attached to one end of an arm 50 whose the other end is pivotably attached to the platen 30. A spring 51 applies pressure against the arm 50 so that the pressure roller 35 applies a tension (e.g., 2.0 kgf) to the conveyor belt 31. The platen 30 is located under the conveyor belt 31 to limit a downward displacement of the conveyor belt 31.

A pinch roller 33 is disposed at a position facing the transport roller 32. The pinch roller 33 is in contact with the conveyor belt 31 and is driven by the movement of the conveyor belt 31. The pinch roller 33 is pushed against the conveyor belt 31 by a spring (not shown) to lead the recording medium P to the recording head unit. Also, the pinch roller 33 is electrically connected to a main frame (not shown) so as to eliminate charge accumulated on a surface of the conveyor belt 31.

At an entrance to the conveyor belt unit 3, where the recording medium P is transported, an upper guide 27 and a lower guide 28 are mounted to guide the recording medium P. On the upper guide 27, a PE sensor lever 23 is mounted to detect the leading edge and trailing edge of the recording medium P and to deliver the detection result to the PE sensor. Furthermore, at a downstream side of the recording medium feed direction from the transport roller 32, the recording unit 7 is disposed to form an image based on image information.

In this structure, the recording medium P is transferred to the conveyor belt unit 3 and is then transferred to a pair consisting of the transport roller 32 and the pinch roller 33 while being guided by the upper guide 27 and the lower guide 28. At the same time, the PE sensor lever 23 detects the leading edge of the transported recording medium P to determine a recording position on the recording medium P. The recording medium P is transported by the conveyor belt 31, which is rotated by a motor via the transport roller 32.

The conveyor belt 31 is a monolithic and seamless belt, which holds the recording medium P and moves while holding the recording medium P. The conveyor belt 31 can be composed of a synthetic resin, such as polyethylene resin and polycarbonate resin, having a thickness of about 0.1 mm to 0.2 mm. If the conveyor belt 31 has a seam, a voltage applied to the conveyor belt may vary at the seam. However, the conveyor belt 31 according to this embodiment is monolithic, and therefore, has no seam. Accordingly, a uniform voltage can be applied to the surface of the belt.

The conveyor belt 31 is composed of the attractive force generation unit 36, in which a first electrode group including a plurality of electrode plates 36*a* and a second electrode group including a plurality of ground plates 36*b* are arranged in a comb shape and the two groups have different voltage levels, a base layer 36*c*, and a surface layer 36*d*. These layers can be bonded together by an adhesive agent or with heat welding, for example.

Figure 2:
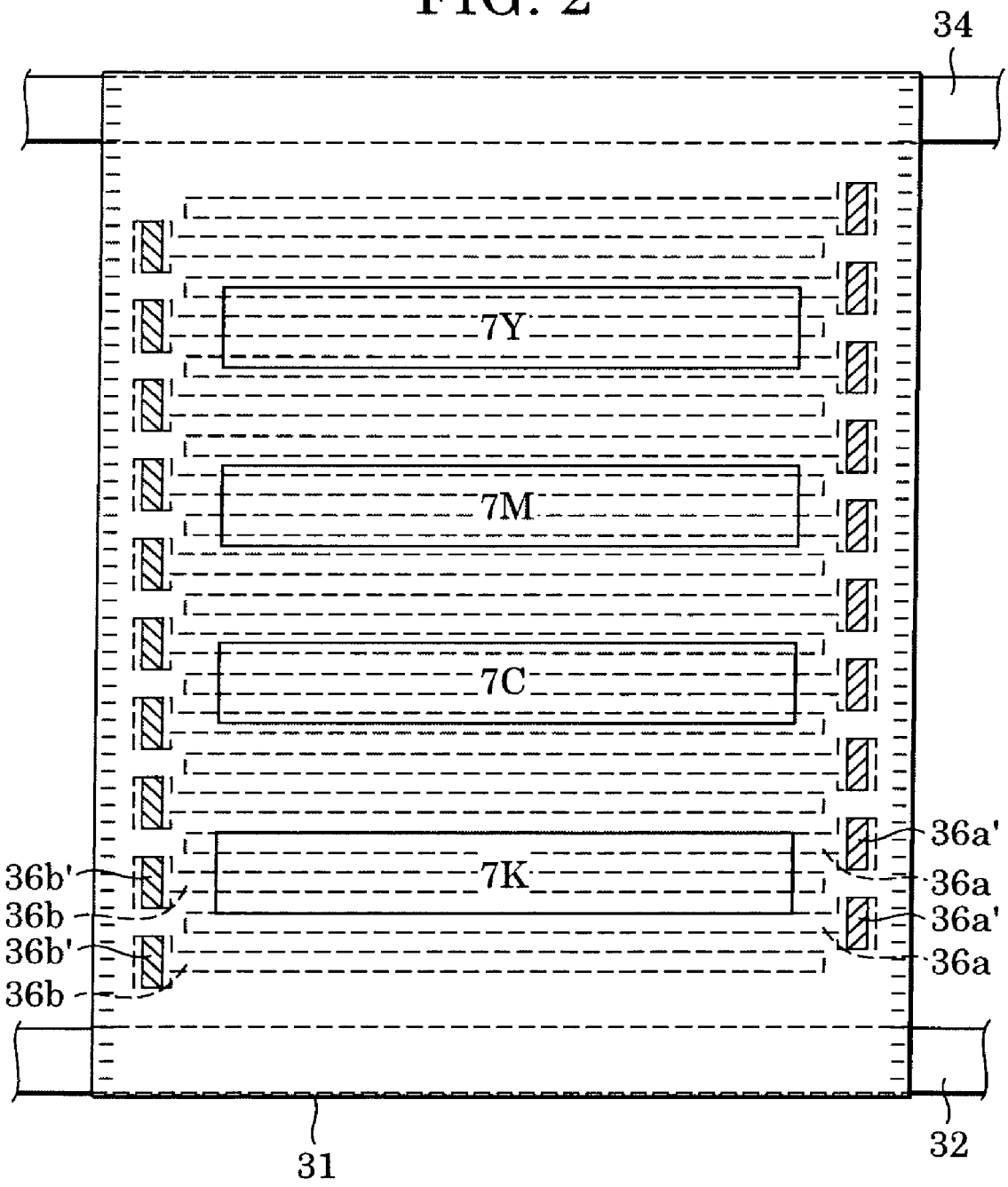
FIG. 2 is a plan view of a conveyor belt.

The attractive force generation unit 36 is described next. As shown in FIG. 2, the attractive force generation unit 36 has conductive metal electrodes having the same polarity and conductive metal electrodes having the reverse polarity or being grounded (i.e., the electrode plates 36*a* and ground plates 36*b*). These two types of the plates are alternately arranged. As shown in the drawing, each tooth in the comb shape is independently arranged and a plurality of the teeth are arranged on the conveyor belt 31 in the direction perpendicular to the moving direction of the conveyor belt 31 while being in parallel to each other. On both sides of the conveyor belt 31 in the moving direction, terminals 36*a'* of the electrode plates 36*a* and terminals 36*b'* of the ground plates 36*b* are exposed from the surface of the conveyor belt 31. The terminals 36*a'* and 36*b'* are used for receiving electric power. The length of each terminal 36*a'* or 36*b'* in the moving direction of the conveyor belt is greater than the width of the electrode plate 36*a* or the ground plate 36*b*. A conductive feeding brush 52 (shown in FIG. 1) is mounted so as to be brought into contact with each terminal at a predetermined pressure. A high-voltage power supply (charging unit or power supply unit) 320 shown in FIG. 3 applies a positive or negative voltage to the terminals 36*a'* of the electrode plates 36*a* via the feeding brush 52. That is, the feeding brush 52 is connected to the power supply 320, which generates a predetermined high voltage power. The feeding brush 52 also causes the voltage of terminals 36*b'* of the ground plates 36*b* to drop to ground. By applying a voltage of about 0.5 kV to 10 kV to the feeding brush 52, an attractive force is generated at a recording position beneath each recording head 7 on the conveyor belt 31.

When a voltage is applied to the electrode plates 36*a*, an electric force is produced in the direction from the electrode plates 36*a* to the ground plates 36*b*, and therefore, electric flux lines are formed. A difference between the voltages of the attractive force generation unit 36 and the voltages of the ground plates 36*b* produces an attractive force above the conveyor belt 31. On the recoding surface of the recording medium P, a charge (surface potential) whose polarity is the same as that of the voltage applied to the electrode plates 36*a* is produced. The force attracting the recording medium P is the weakest between the electrode plate 36*a* and the ground plate 36*b*, where no conductive metal exists.

A pair of cleaning rollers 38 is mounted such that the conveyor belt 31 moves in the nip between the pair of cleaning rollers 38. The pair of cleaning rollers 38 is composed of a durable foam sponge having small air holes whose diameter is about 10 to 30 μm for absorbing ink so as to clean contamination of ink deposited to the conveyor belt 31. The conveyor belt 31 is first cleaned up by the pair of cleaning rollers 38, and is then discharged by a discharge brush 37, which is a discharge unit.

The duplex transport unit 6 turns over the recording medium P transported by the conveyor belt 31 with the first surface upward and delivers it again to the conveyor belt 31 with the second surface upward. More specifically, the duplex transport unit 6 turns over the recording medium P as follows: First, the duplex transport unit 6 moves the recording medium P having a recorded first surface to an output side. When the trailing edge of the recording medium P arrives at a nip defined by an output roller 41 and a spur 42, the duplex transport unit 6 moves the recording medium P in the reverse direction by counter-rotating the output roller 41. The recording medium P is guided into a duplex conveying path 61 located under the conveyor belt unit 3, as shown in FIG. 1. The recording medium P is then transported by a plurality of transport rollers in the duplex conveying path 61 and moves through a nip defined by the transport roller 32 and the pinch roller 33 again. Thereafter, the recording medium P is delivered onto the conveyor belt 31. Consequently, the recording medium P can be directed towards the recording unit 7 with a surface (the second surface) that is the flip side to the recorded surface (the first surface) upward, thus allowing double-sided recording. The duplex conveying path 61 can support a plurality of recording media.

The recording unit 7 employs a line-type inkjet recording head in which a plurality of nozzles are arranged in the direction orthogonal to the feed direction of the recording medium P. From the upstream side of the feed direction of the recording medium P, inkjet recording heads 7K (black), 7C (cyan), 7M (magenta), and 7Y (yellow) are arranged in this order and are spaced by a predetermined distance. The recoding heads 7K, 7C, 7M, and 7Y are mounted on a head holder 7*a*. Ink in these recoding heads can receive heat from a heater. The heat causes film boiling of the ink. The film boiling expands and contracts an ink bubble, thus causing pressure variation inside the nozzle. The pressure variation ejects the ink from the nozzle to the recording medium P, and therefore, an image is formed on the recording medium P.

One end of the recording unit 7 is rotatably mounted on a shaft 71. A protrusion 7B formed on the other end of the recording unit 7 is engaged with a rail 72, thereby defining a gap between the nozzle surface and the recording medium P.

The output unit 4 includes the output roller 41 and the spur 42. The recording medium P recorded in the recording unit 7 is advanced through a nip formed by the output roller 41 and the spur 42 to be outputted onto an output tray 43. The output roller 41 is driven by the torque of the driving roller 34 via a transfer mechanism (not shown). The spur 42 is a roller that rolls on the recorded surface. Accordingly, the spur 42 is designed such that the contact area with the recording medium is small enough not to deform a recorded image even when the rotator is brought into contact with the recorded surface of the recording medium.

Figure 3:
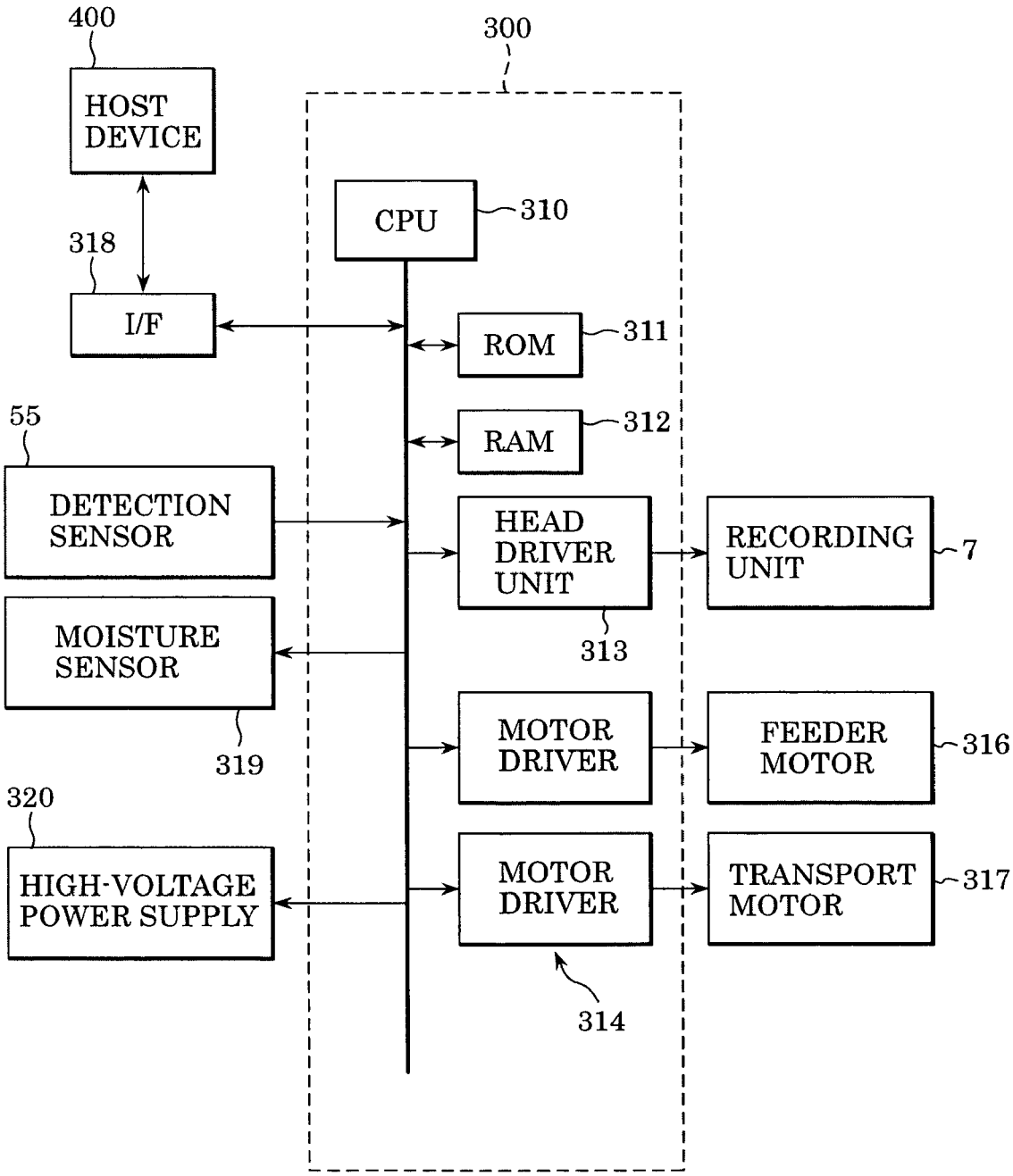
FIG. 3 is a block diagram of a control circuit of the recording apparatus.

FIG. 3 is a block diagram of a control circuit of the recording apparatus according to this embodiment. As shown in FIG. 3, a control unit 300 includes a CPU (central processing unit) 310 for issuing various control instructions, a ROM (read only memory) 311 for storing control data, and a RAM (random access memory) 312 used for expanding recording data. A feeder motor 316 drives the feeding rotator 22, and a transport motor 317 drives the driving roller 34. A head driver 313 drives the recording unit (recording heads 7Y, 7M, 7C, and 7K). A plurality of motor drivers 314 drive the feeder motor 316 and the transport motor 317. An interface (I/F) 318 transfers data between the control unit 300 and a host device 400, such as a computer and a digital camera.

Figure 4:
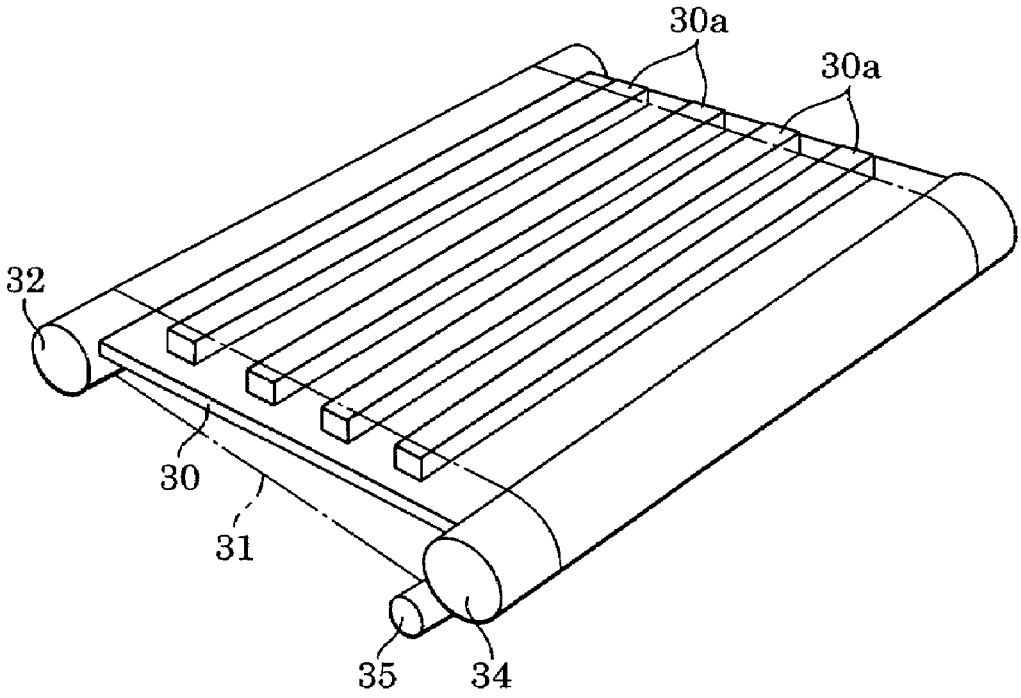
FIG. 4 is a perspective view of the conveyor belt.
Figure 5:
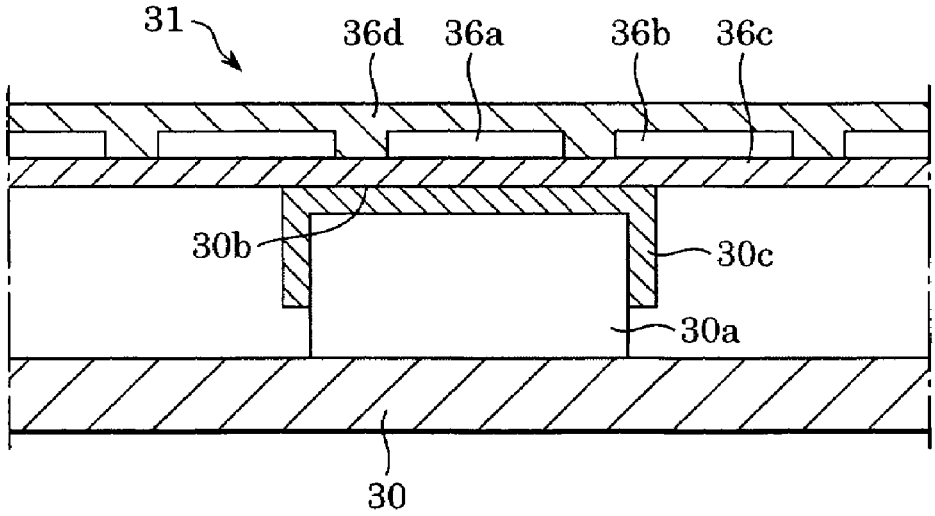
FIG. 5 is a sectional view of the conveyor belt.

The structure of the conveyor belt unit according to the embodiment is described in more detail with reference to FIGS. 4 and 5. FIG. 4 is a perspective view of the overall structure of the conveyor belt unit. FIG. 5 is a diagram illustrating the platen.

First, the platen 30 is described next. As shown in FIGS. 4 and 5, bumps 30*a* are arranged at positions facing the recording heads 7K, 7C, 7M, and 7Y on the platen 30. That is, each of the bumps 30*a* is disposed in the direction of a nozzle line (in the direction orthogonal to the feed direction). The direction is parallel to nozzle faces.

A surface 30*b* of the bump 30*a* facing the conveyor belt 31 has a predetermined width (in the feed direction). All of the surfaces 30*b* are in the same imaginary plane. To obtain a sufficient attractive force, the bumps 30*a* are made from a conductive material. A low-friction layer 30*c*, such as a Teflon® film or a high-molecular-weight polyethylene film having a thickness of 100 μm and a friction coefficient of 0.2 is formed on all of the surfaces 30*b*, which are in sliding contact with the conveyor belt 31. During transportation, the friction between the surface 30*b* and the conveyor belt 31 can be reduced and the stable rotational load of the conveyor belt 31 can be obtained, thus ensuring the feed precision.

A principal to prevent residual deformation of the conveyor belt 31 due to an attractive force and vibration of the conveyor belt 31 during transportation is described next.

First, the shape of the residual deformation is described next. As described above, the conveyor belt 31 includes the attractive force generation unit 36 (the electrode plates 36*a* and the ground plates 36*b*), the base layer 36*c*, and the surface layer 36*d*. All of the layers are bonded by an adhesive agent or heat welding, for example. Due to the difference in material properties for curvature, if the conveyor belt unit 3 remains unused in the recording apparatus 1 for a long time, permanent deformation may occur at portions having a large curvature, such as portions in contact with the transport roller 32, the driving roller 34, and the pressure roller 35 (a creep problem). When the transport operation starts in this state, a portion of the conveyor belt 31 stretched between the transport roller 32 and the driving roller 34 is pulled in the transport direction by the tension applied by the pressure roller 35. At that time, the permanent deformation of the conveyor belt 31 causes waves with a height of about 0.5 to 1.0 mm on the conveyor belt 31 at a position facing the recording head.

In this embodiment, by applying a high voltage (0.5 kV to 10 kV) to the electrode plates 36*a* of the comb-shaped electrodes in the conveyor belt 31 to generate an electrical force, the recording medium P is attracted to the upper surface of the conveyor belt 31. Thus, the cockling of the conveyor belt 31 is prevented. Similarly, the lower surface of conveyor belt 31 is attracted to the bumps 30*a* of the platen 30. Thus, the waves of the conveyor belt 31 are prevented. As a result, stable recording on the recording medium P and stable transportation of the recording medium P by the conveyor belt 31 can be achieved.

In terms of the attractive force, the conveyor belt 31 and the bumps 30*a* are modeled as capacitors connected in series (refer to FIGS. 6B and 6C). Therefore, an equation shown in FIG. 6A can be obtained. As can be seen by the equation, as a voltage applied to the electrode plates 36*a* of the conveyor belt 31 increases, that is, as a difference between potentials of the first electrode group and the second electrode group increases, the attractive force between the conveyor belt 31 and the platen 30 increases. In contrast, as the distance between the conveyor belt 31 and the platen 30 increases, the attractive force decreases.

On the other hand, when the recording medium P used for double-sided recording is attracted to the conveyor belt 31, the inventor of the present invention discovered that the applied voltage should be changed based on whether recording is carried out on the first surface of the recording medium P or on the second surface of the recording medium P after recording on the first surface is completed and the recording medium P is delivered to the duplex transport unit 6. When recording is carried out on the second surface, ink drops have already been ejected onto the recording medium P. Therefore, the moisture content of the recording medium P is changed. If the moisture content increases, the attractive force decreases. This is the reason for the discovery. Also, when environmental conditions vary, in particular, in a high-humidity environment, the moisture content of the recording medium P increases. Consequently, the attractive force may decrease even in the case of single-sided recording.

Figure 7:
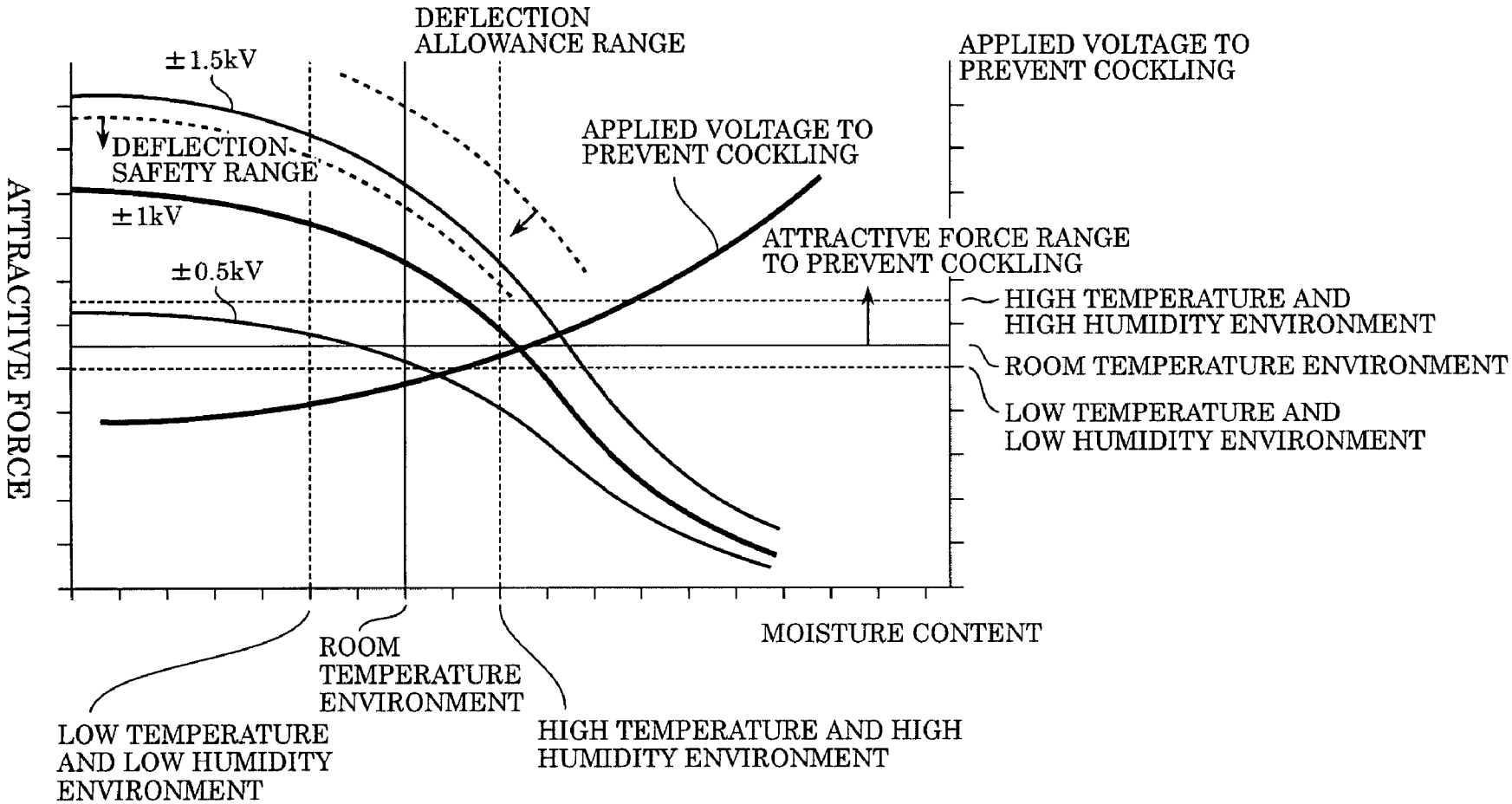
FIG. 7 is a diagram illustrating the change in an attractive force between the conveyor belt and a recording medium in accordance with the change in the environment.
Figure 8:
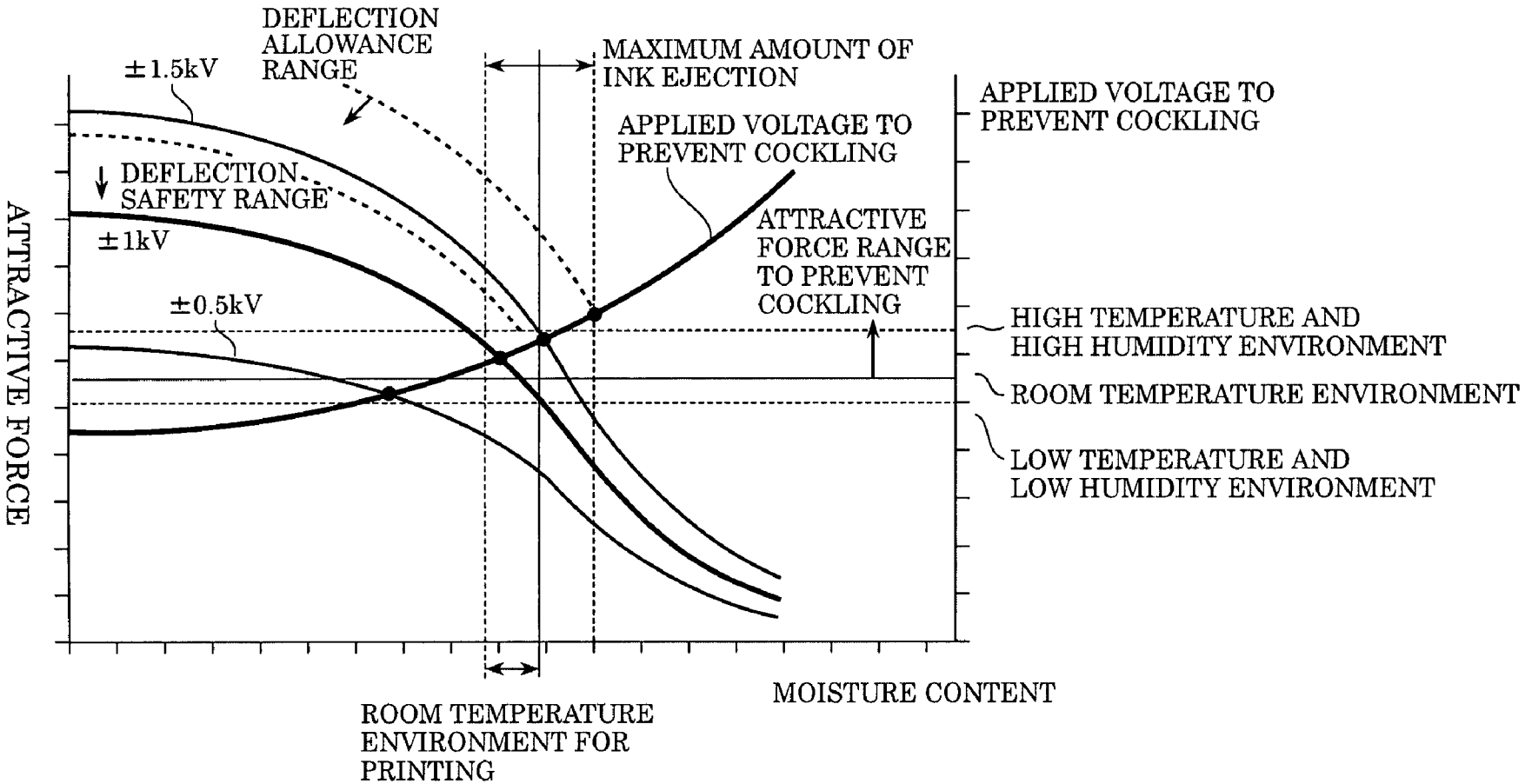
FIG. 8 is a diagram illustrating the change in an attractive force between the conveyor belt and a recording medium depending on the difference between surfaces of the recording medium.

Accordingly, the present inventor attempted to reliably attract a recording medium to a conveyor belt in both cases of single-sided recording and double-sided recording by mounting a moisture detection sensor 319, shown in FIG. 3, in the vicinity of the conveyor belt, determining an applied voltage for the single-sided recording, and further varying an applied voltage for the double-sided recoding. FIGS. 7 and 8 show the relationship among an attractive force, a moisture content, and an applied voltage. In FIGS. 7 and 8, the ordinate represents the attractive force and the applied voltage to prevent cockling, and the abscissa represents the moisture content of a recording medium.

As shown in FIG. 7, if the moisture content of the recording medium increases, the attractive forces when an applied voltage to the electrode plates 36*a* is changed to ±0.5 kV, ±1.0 kV, and ±1.5 kV (i.e., +0.5 kV or −0.5 kV, +1.0 kV or −1.0 kV, and +1.5 kV or −1.5 kV; hereinafter the same applies) all decrease. Additionally, when the applied voltage is high and the ink drop is ejected from the recording head, the direction of an ink drop is shifted due to an electric field. As used herein, this phenomenon is referred to as "deflection", and deflection safety range curves and deflection allowance range curves are written above and under the ±1.5 kV-curve. If the voltage is within the deflection allowance range, the deflection does not affect the recording quality. However, the voltage is within the deflection safety range.

Additionally, when ink is ejected onto a recoding medium, water content in the ink swells the recording medium and causes cockling of the recording medium. The "applied voltage to prevent cockling" is an applied voltage to prevent this phenomenon. As can be seen by FIG. 7, to attract a recording medium to the conveyor belt in a normal room temperature environment, an applied voltage of about ±0.6 kV is required. However, in a low temperature and low humidity environment, an applied voltage of about ±0.4 kV is sufficient. In a high temperature and high humidity environment, an applied voltage of about ±1.0 kV is required. This is because the moisture content in the recording medium varies in accordance with environmental conditions. In particular, in a high temperature and high humidity environment, the moisture content is high, thus decreasing the attractive force. Accordingly, as the moisture content increases, a higher voltage applied to the conveyor belt 31 is required.

Figure 9:
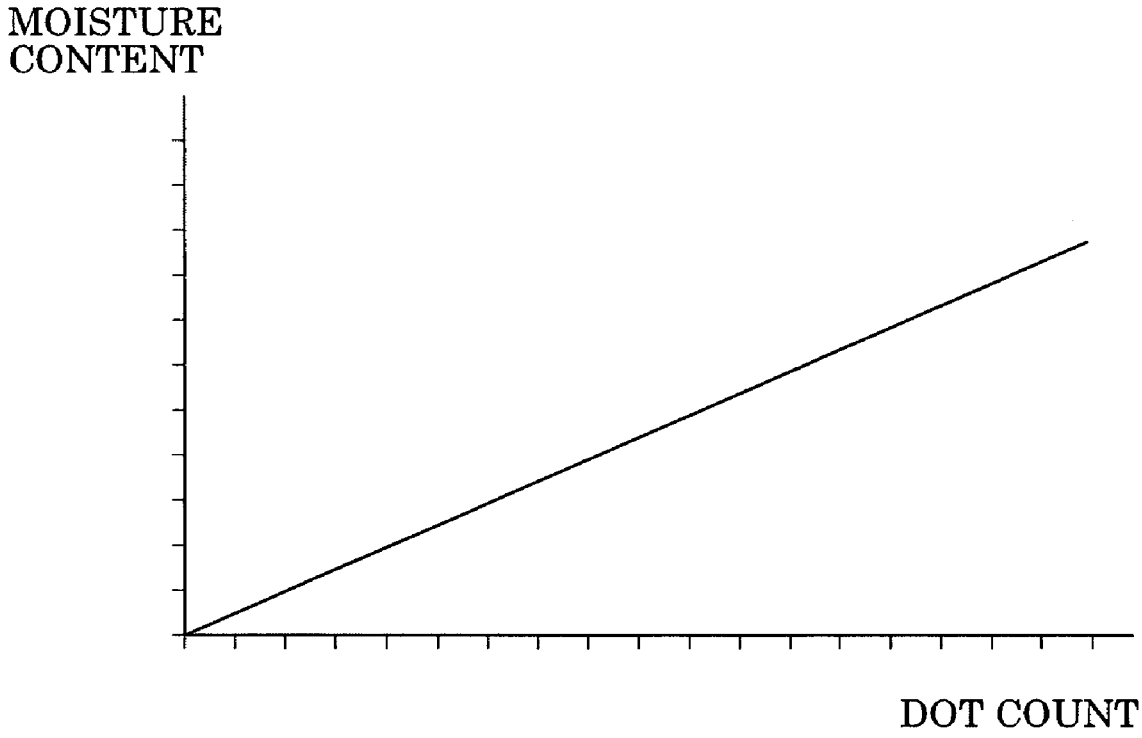
FIG. 9 is a diagram illustrating a relationship between moisture content of the recording medium and a dot count.
Figure 10:
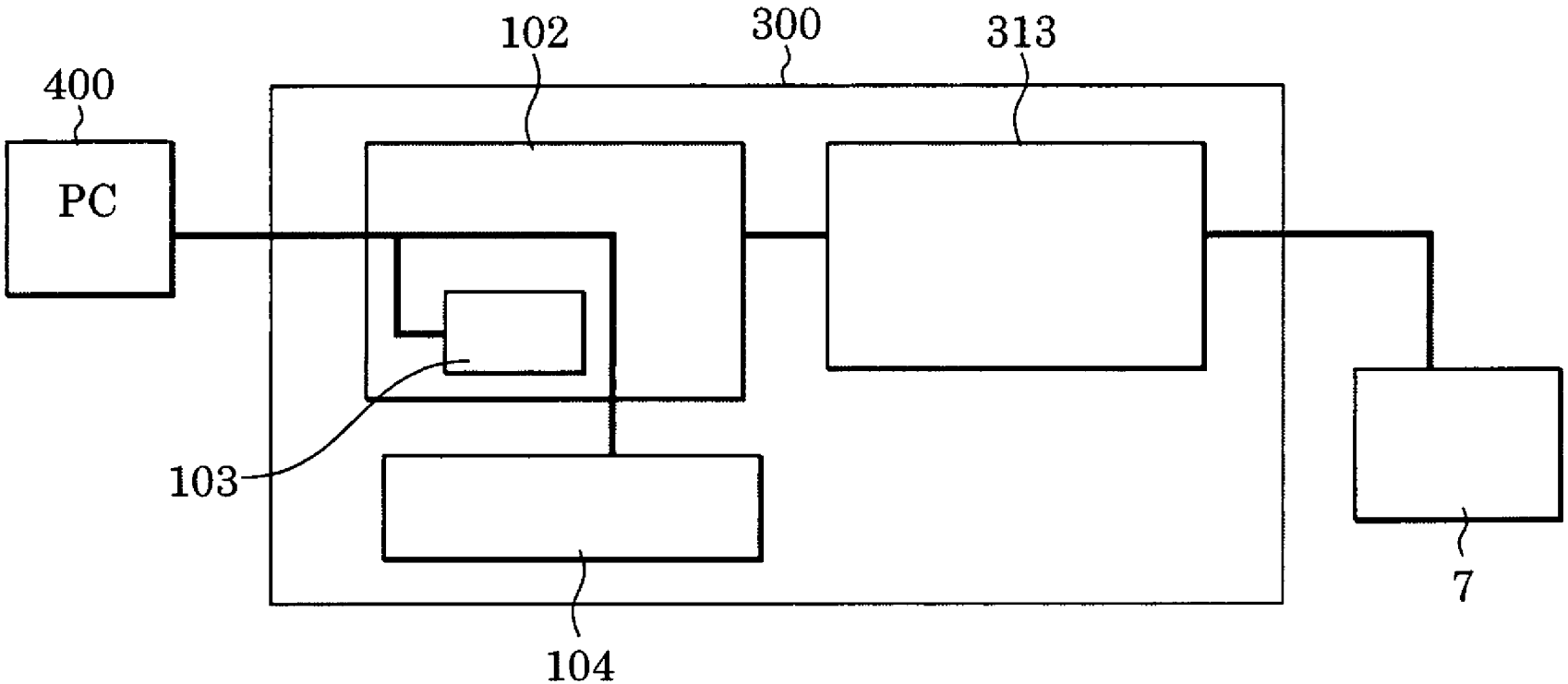
FIG. 10 is a block diagram illustrating a control unit.

As shown in FIG. 9, as an amount of ink drops ejected onto the recording medium P increases due to the increase in an amount of information to be recorded on the recording medium P, the moisture content of the recording medium P increases, due to water in ink, in proportion with the amount of ink drops. Thus, the increase in moisture content of the recording medium P prevents the recording medium P from being attracted to the conveyor belt 31. Therefore, as shown in FIG. 10, a dot counter unit 103 for calculating an amount of ink drops (i.e., an amount of information to be recorded) is provided in the control unit 300 of the recording apparatus 1 so that, when the recording is carried out on the second surface, a voltage applied to the conveyor belt 31 is changed based on information about recording on the first surface. The information is received from the dot counter unit 103. As a result, as in recording on the first surface, the recording medium P can be reliably attracted to the conveyor belt 31 in recording on the second surface.

The control unit of the transport apparatus and the recording apparatus is described next. As shown in FIG. 10, the control unit 300 of the recording apparatus 1 includes an image processing unit 102 for processing image information from a personal computer and a head control unit 313 for controlling the drive of the recording unit 7 based on information from the image processing unit 102. The image processing unit 102 includes the dot counter unit 103 for counting an amount of recording information transferred to the head control unit 313 and a page memory (a storage unit) 104 capable of storing image information about a plurality of recording media held in the duplex conveying path 61. These units are composed of the CPU 310, the ROM 311, and the RAM 312 shown in FIG. 3.

In terms of a voltage applied to the conveyer belt and an attractive force, the differences between those at double-sided transportation and those at single-sided transportation are described next.

As shown in FIG. 8, in order to attract a recording medium to the conveyer belt when standard image recording is carried out in single-sided transportation, a required voltage applied to a conveyer belt is about ±1.0 kV. When double-sided transportation is carried out via the duplex transport unit 6 and recording is carried out in this environment, ink has already been ejected onto the recording medium, and therefore, the moisture content of the recording medium has already increased (refer to the line indicated as "two-side printing" in FIG. 8).

In this case, to reliably attract the recording medium to the conveyer belt, a higher voltage (absolute voltage) must be applied to the conveyer belt. In the above-described environment, the required voltage applied to the recording medium in double-sided transportation is ±1.5 kV. That is, in double-sided transportation, a higher voltage incremented by at least ±0.5 kV is required as compared to the voltage in single-sided transportation.

If an amount of ink ejection from the recording head to the recording medium is maximized, the moisture content further increases. Accordingly, to stably transport the recording medium for double-sided recording, the voltage applied to the conveyer belt should be further increased. In this embodiment, when a maximum amount of ink is ejected from the recording head in single-sided transportation, a voltage applied to the conveyer belt is ±2.0 kV. That is, in double-sided transportation, a higher voltage incremented by at least ±1.0 kV is required as compared to the voltage in single-sided transportation.

Therefore, in this embodiment, a recording medium is reliably attracted to the conveyer belt by increasing a voltage applied to the conveyer belt in double-sided transportation as compared to the voltage in single-sided transportation. That is, the voltage applied to the conveyer belt is changed such that a difference between potentials of the conveyer belt and the recording medium when the recording medium is transported with the second surface upward is greater than that when the recording medium is transported with the first surface upward.

That is, the absolute value of a voltage applied to the electrode plates 36*a* is increased such that a difference between potentials of the first electrode group and the second electrode group when the recording medium is transported with the second surface upward is greater than that when the recording medium is transported with the first surface upward.

For example, when a recording medium is transported with the second surface upward, the absolute value of a voltage applied to the electrode plates 36*a* is increased so that a difference between potentials of the first electrode group and the second electrode group is set to a first potential difference when an recording amount stored in the storage unit is a first recording amount, and when the recording amount stored in the storage unit is a second recording amount greater than the first recording amount, the difference between potentials of the first electrode group and the second electrode group is set to a second potential difference greater than the first potential difference.

The configuration for varying the applied voltage is described in detail next. When recording is carried out on a first surface, the dot counter unit 103 first calculates an amount of ink ejection to the recording medium P (i.e., an amount of recording on the recording medium P). The control unit 300 then determines the moisture content of the recording medium P based on the calculated value from the dot counter unit 103. Subsequently, the control unit 300 determines an optimal increased voltage applied to the conveyor belt in accordance with the change in the moisture content using, for example, the relationship indicated by a graph in FIG. 8, and therefore, the control unit 300 further increases the applied voltage.

According to the embodiment, a recording apparatus having such a configuration can reliably attract a recording medium to the conveyor belt by applying a desired voltage to the conveyor belt in order to increase an attractive force between the recording medium and the conveyor belt when transporting a recording medium having cockling due to high moisture content. Since the recording medium is reliably attracted to the conveyor belt, a distance between the recording head and the recording medium can be maintained constant, and therefore, the recording quality can be maintained even in double-sided transportation.

To carry out recording on both sides of a recording medium, recording on a first surface is first carried out and then recording on a second surface is carried out. In continuous recording, if, after recording is carried out on both sides of a recording medium, the next recording medium is supplied, a high-speed recording required in recent years cannot be achieved. In this embodiment, to solve this problem, a recording medium is temporarily held in the duplex conveying path 61 after recording on the first surface is completed.

Immediately after a first recording medium whose first surface is recorded is delivered to the duplex conveying path 61, recording is carried out on a first surface of the subsequent recording medium. As the subsequent recording medium is advanced in the duplex conveying path 61, the first recording medium is advanced to a position facing the recording unit 7. The recording unit 7 carries out recording on a second surface of the delivered first recording medium.

As described above, immediately after recording is carried out on a first surface of a first recording medium and the first recording medium is delivered to the duplex conveying path 61, recording is carried out on a first surface of the subsequent recording medium. Subsequently, immediately after the subsequent recording medium is delivered into the duplex conveying path 61, the first recording medium is advanced to a position facing the recording unit 7. The recording unit 7 carries out recording on a second surface of the delivered first recording medium. Thus, by alternately carrying out recoding on the first surface of the subsequent recording medium and recoding on the second surface of the first recording medium, the recoding process can be speeded up.

In this embodiment, two types of recording media, namely, the first and the subsequent recording media are described as examples. However, the present invention is not limited thereto. That is, the duplex conveying path 61 may hold a plurality of recording media. Here, the dot counter unit 103 includes the page memory 104 for storing a recording amount for each of a plurality of recording media, as described above. Accordingly, by storing a recording amount of a first surface of each recording medium, the alternate recording on the first surface and the second surface can be carried out more smoothly.

In this case, the control unit alternately changes a voltage applied to a recording medium based on whether recording is carried out on a first surface or on a second surface in accordance with data calculated from a recording amount by the dot counter unit 103.

For changing the voltage, it is designed so that a distance between the recoding media is greater than a distance between the first recording head and the last recording head. Thus, a voltage applied to each electrode can be independently controlled for each recording medium. In the actual example, the distance between the first recording head and the last recording head is about 80 mm, the distance between the recoding media is about 100 mm, and an area where the control voltage is applied is about 90 mm. These values allow the independent control.

Figure 11:
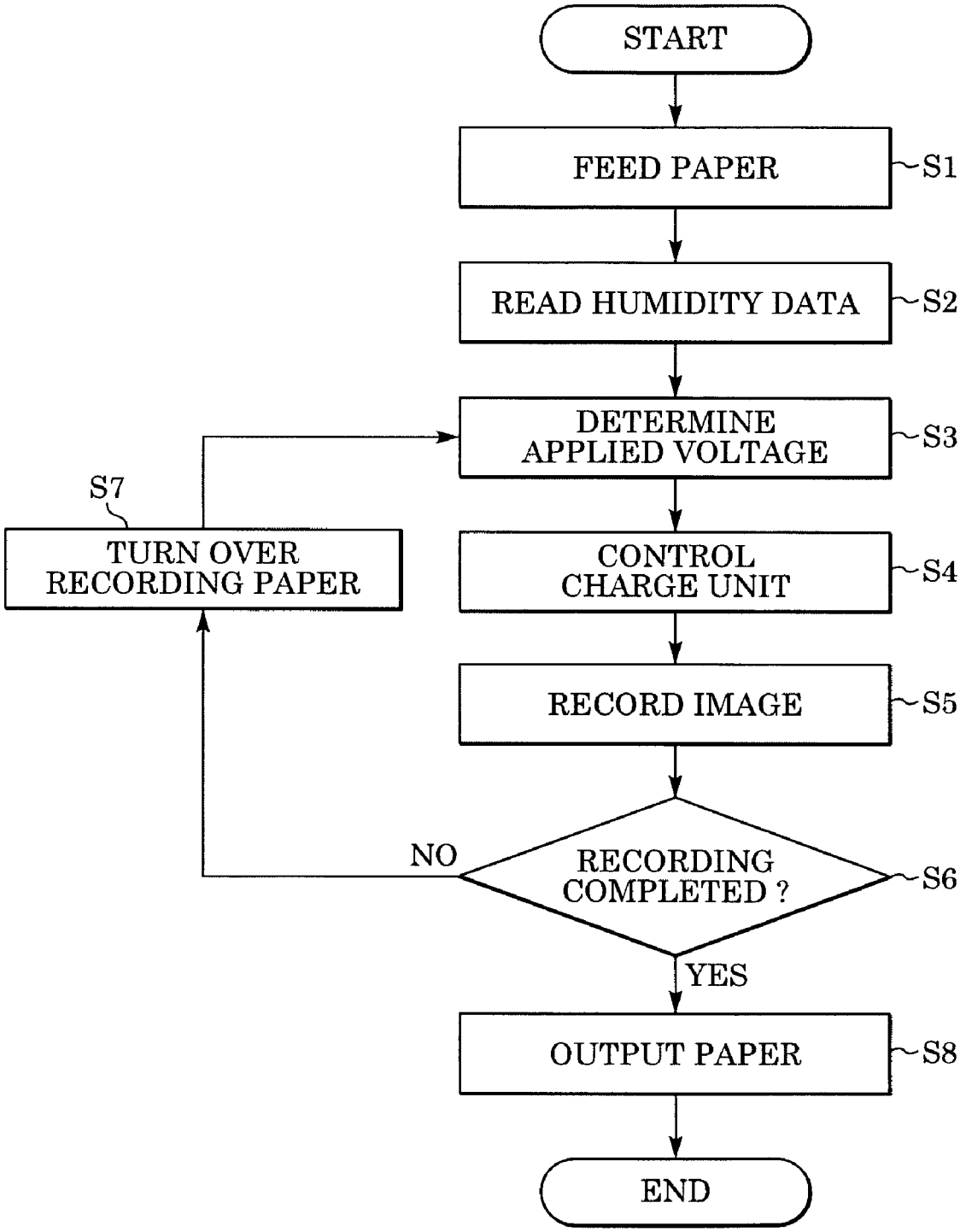
FIG. 11 is a flow chart of the control operation by the recording apparatus.

FIG. 11 is a flow chart of the control operation by the recording apparatus according to the embodiment. At step S1, a feeder motor 316 and a transport motor 317 are driven so that a recording medium is fed to the recording unit. At step S2, the detection result of a moisture sensor 319 is inputted. At step S3, a voltage applied to each electrode is determined based on the detection result of a moisture sensor 319 and whether recording is to be carried out on a first surface or on a second surface. At step S4, the high-voltage power supply 320 is controlled based on the determined voltage so that the determined voltage is applied to each electrode. At step S5, the recording unit 7 records an image on the recording medium based on image information. At step S6, it is determined whether recording is to be carried out on the other surface. If the recording on the other surface is required, the recording medium, at step S7, is delivered to the duplex transport unit, where the recording medium is turned over and is then delivered to the recording unit 7 again. If it is determined at step S6 that the recording is completed, the recording medium is ejected to outside of the apparatus via the output unit 4.

Other Embodiments

In the first embodiment, the control unit detects the moisture content and the recording amount of a recording medium and changes a voltage applied when single-sided recording is carried out and a voltage applied when double-sided recording is carried out. However, the present invention is not limited thereto. For example, an applied voltage may be changed such that a constant additional voltage (e.g., ±0.5 kV) is added to an applied voltage when recording on the opposing surface to a first surface (i.e., a second surface) is carried out as compared to recording on the first surface.

While the above-described embodiment of the present invention has been described with reference to a seamless and monolithic conveyor belt as a transport member, the present invention is not intended to be limited to such an application. For example, a drum may be used as a transport member.

Additionally, while the above-described embodiment of the present invention has been described with reference to an inkjet duplex recording apparatus having a plurality of recording heads using different color inks, the present invention is not intended to be limited to such an application. For example, the present invention may be applied to an inkjet recording apparatus having a single recording head or an inkjet recording apparatus having a plurality of recording heads for recording tone of an image using ink having the same color and different density. That is, the present invention may be applied to a recording apparatus having any number of heads while providing the same advantages.

Furthermore, the present invention can be applied to a recording apparatus having any recording unit and any structure of an ink tank. For example, the recording unit may be of a cartridge type combining a recording head and an ink tank, or a unit of a recording head and an ink tank connected by an ink supply tube.

The present invention may be applied to an inkjet recording apparatus. For example, the present invention can be applied to an inkjet recording apparatus having recording unit using an electromechanical transducer, such as a piezoelectric device. In particular, the present invention is advantageously applied to an inkjet recording apparatus employing a method in which ink is ejected by thermal energy, since this method facilitates higher-resolution recording.

Furthermore, the present invention can be advantageously applied to a recording apparatus of a so-called serial type, in which recording is carried out by moving a recording head in the direction orthogonal to a feed direction of a recording medium. Alternatively, the recording apparatus may be of a full-line type, in which a recording head has a length corresponding to a maximum width of a recording medium. In such a case, the recording head may be composed of a combination of a plurality of recording heads or may be composed of an integrated recording head unit. In addition, the present invention can be applied to a recording apparatus having a serial-type head secured to the body of an apparatus, a recording apparatus having a removable chip-type serial head, or a recording apparatus having a cartridge serial-type head having a built-in ink tank. The removable chip-type serial head is mounted and electrically connected to the body of the apparatus, and is supplied with ink from the body of the apparatus.

Still furthermore, the above-described inkjet recording apparatus may be an image output peripheral of an information processing apparatus, such as a computer, may be an inkjet input and output peripheral capable of mounting a scanner on a carriage as well as a recording head, may be a copier with a reader, or may be a facsimile apparatus having a data transmitting and receiving function.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-165803 filed Jun. 3, 2004, and Japanese Patent Application No. 2004-165804 filed Jun. 3, 2004, which are hereby incorporated by reference herein.

What is claimed is:

1. A recording apparatus comprising:

a recording unit configured to record images on a recording medium by ejecting ink onto the recording medium;

a conveyor belt configured to transport the recording medium in a transport direction to the recording unit;

a first electrode group including a plurality of first electrodes inside the conveyor belt, the first electrodes being arranged in the transport direction;

a second electrode group including a plurality of second electrodes inside the conveyor belt, each second electrode being disposed between the first electrodes;

a charging unit configured to charge the first electrode group and the second electrode group to provide a potential difference between the first electrode group and the second electrode group in order to generate an electrostatic force to attract the recording medium to the conveyor belt during transporting the recording medium;

a duplex transport unit configured to turn over the recording medium transported by the conveyor belt from a first surface upward to a second surface upward and delivering the recording medium to the conveyor belt with the second surface upward in order to carry out recording on the second surface of the recording medium having a recorded first surface;

a storage unit configured to store a recording amount that has been recorded on the first surface of the recording medium; and a control unit controlling the charging unit so that the difference between potentials of the first electrode group and the second electrode group during transportation of the recording medium with the second surface upward is different from the difference between potentials of the first electrode group and the second electrode group during transportation of the recording medium with the first surface upward, wherein the control unit controls the charging unit so that the difference between potentials of the first electrode group and the second electrode group during transportation of the recording medium with the second surface upward is a first potential difference when the recording amount stored in the storage unit is a first recording amount, and a second potential difference greater than the first potential difference when the recording amount stored in the storage unit is a second recording amount more than the first recording amount.

2. The recording apparatus according to claim 1, wherein the control unit controls the charging unit so that the difference between potentials of the first electrode group and the second electrode group during transportation of the recording medium with the second surface upward is greater than the difference between potentials of the first electrode group and the second electrode group during transportation of the recording medium with the first surface upward.

3. The recording apparatus according to claim 1, wherein the recording unit includes an inkjet recording head configured to eject ink onto the recording medium.

4. A recording apparatus comprising:

a recording unit configured to record images on a recording medium by ejecting ink onto the recording medium;

a conveyor belt configured to transport the recording medium in a transport direction to the recording unit;

a first electrode group including a plurality of first electrodes inside the conveyor belt, the first electrodes being arranged in the transport direction;

a second electrode group including a plurality of second electrodes inside the conveyor belt, each second electrode being disposed between the first electrodes;

a charging unit configured to charge the first electrode group and the second electrode group to provide a potential difference between the first electrode group and the second electrode group in order to generate an electrostatic force to attract the recording medium to the conveyor belt during transporting the recording medium;

a duplex transport unit configured to turn over the recording medium transported by the conveyor belt from a first surface upward to a second surface upward and delivering the recording medium to the conveyor belt with the second surface upward in order to carry out recording on the second surface of the recording medium having a recorded first surface;

a storage unit configured to store a recording amount that has been recorded on the first surface of the recording medium; and a control unit controlling the charging unit so that the difference between potentials of the first electrode group and the second electrode group during transportation of the recording medium with the second surface upward is a first potential difference when the recording amount stored in the storage unit is a first recording amount, and a second potential difference greater than the first potential difference when the recording amount stored in the storage unit is a second recording amount more than the first recording amount.

5. A recording apparatus according to claim 4, wherein the storage unit stores a recording amount on the first surface of the recording medium, and the control unit controls the charging unit based on the recording amount on the first surface of the recording medium stored by the storage unit.

* * * * *